US007722046B2

(12) United States Patent
Lawrence et al.

(10) Patent No.: US 7,722,046 B2
(45) Date of Patent: May 25, 2010

(54) CASINO ROULETTE GAME

(75) Inventors: Sidney Robert Lawrence, 53 Benchview Dr., Tooele, UT (US) 84074; John Royal Jensen, Tooele, UT (US)

(73) Assignee: Sidney Robert Lawrence, Tooele, UT (US)

( * ) Notice: Subject to any disclaimer, the term of this patent is extended or adjusted under 35 U.S.C. 154(b) by 0 days.

(21) Appl. No.: 12/273,932

(22) Filed: Nov. 19, 2008

(65) Prior Publication Data

US 2009/0127780 A1 May 21, 2009

Related U.S. Application Data

(60) Provisional application No. 60/989,423, filed on Nov. 20, 2007.

(51) Int. Cl.
*A63F 5/00* (2006.01)

(52) U.S. Cl. ..... 273/274; 273/142 J; 273/142 R; 273/142 JA

(58) Field of Classification Search ..... 273/274, 273/142 R, 142 E–142 H, 142 HA, 142 J, 273/142 JA–142 JD
See application file for complete search history.

(56) References Cited

U.S. PATENT DOCUMENTS 1,702,246 A * 2/1929 Blattner ..... 273/243
5,184,821 A * 2/1993 Korenek ..... 273/138.2
5,487,547 A * 1/1996 Hobert ..... 273/274
6,302,395 B1 10/2001 Astaneha
6,520,503 B1 * 2/2003 Porto ..... 273/274
6,554,281 B2 4/2003 Flannery
6,769,693 B2 8/2004 Huard et al.
7,195,242 B2 3/2007 Terminel et al.
7,431,298 B1 10/2008 Carbonaro
2001/0015529 A1 8/2001 Allen
2005/0167912 A1 8/2005 Sokolov
2007/0052173 A1 3/2007 Dargue
2008/0088086 A1 4/2008 Kling et al.
2008/0106037 A1 5/2008 Smith et al.
2008/0252004 A1 10/2008 Au-Yeung

* cited by examiner

*Primary Examiner*—Benjamin H Layno
(74) *Attorney, Agent, or Firm*—Workman Nydegger

(57) ABSTRACT

A game apparatus having a roulette wheel with a plurality of wheel sections, a pointer for randomly selecting one of the wheel sections, and a playing surface adapted for placing wagers concerning the randomly selected wheel section. Each of the wheel sections has two separate number representations, such as the faces of a pair of dice, which are summed to represent a summation for the wheel section. The playing surface has a plurality of wager sections corresponding to the summations of the wheel sections on the roulette wheel. The roulette wheel can further include a second plurality of wheel sections having representations of the suits of a deck of playing cards thereon and the playing surface can further include one or more wager sections corresponding to the second plurality of wheel sections.

17 Claims, 5 Drawing Sheets

CASINO ROULETTE GAME

CROSS-REFERENCE TO RELATED APPLICATIONS

This application claims the benefit of U.S. Provisional Patent Application Ser. No. 60/989,423, filed Nov. 20, 2007, which application is incorporated herein by specific reference in its entirety.

BACKGROUND OF THE INVENTION

1. The Field of the Invention

The present invention relates to casino roulette games. More specifically, the present invention relates to games of chance that use vertical or horizontal roulette wheels.

2. The Relevant Technology

The general concept of the roulette wheel having a large number of wheel sections has been known for some time. Each of the wheel sections typically corresponds to a unique number or other indicia. Various wheel sections can also correspond to different groupings, such as by color, odd or even numbering, or the like. Standard roulette game rules generally permit players to place wagers on one or more of the sections of the wheel, with various wagering combinations also being permitted based on the wheel section groupings.

After wagers have been placed, the wheel is spun and one of the wheel sections is randomly selected by an indicator. This is generally done in one of two ways, depending on the orientation of the wheel. For horizontally inclined wheels, a ball is introduced to the spinning wheel and randomly selects a pocket associated with one of the wheel sections. For vertically oriented wheels, a pointer is used to gradually slow down the wheel and randomly point to one of the wheel sections when the wheel comes to a stop.

Once a wheel section has been randomly selected, winnings are paid to the players that have correctly wagered on the selected wheel section or one of the groupings that includes the selected wheel section. All losing wagers are forfeited to the house and new wagers are then placed for the next spin of the wheel.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope. In the drawings, like parts are given like reference numerals.

DETAILED DESCRIPTION OF THE PREFERRED EMBODIMENTS

The present invention is directed to a game apparatus used in a game of chance. The game apparatus includes a roulette wheel assembly having a roulette wheel and a playing surface for placing wagers on the outcome of a spin of the wheel. Various methods of playing the game of chance using the game apparatus are also disclosed herein.

Figure 1:
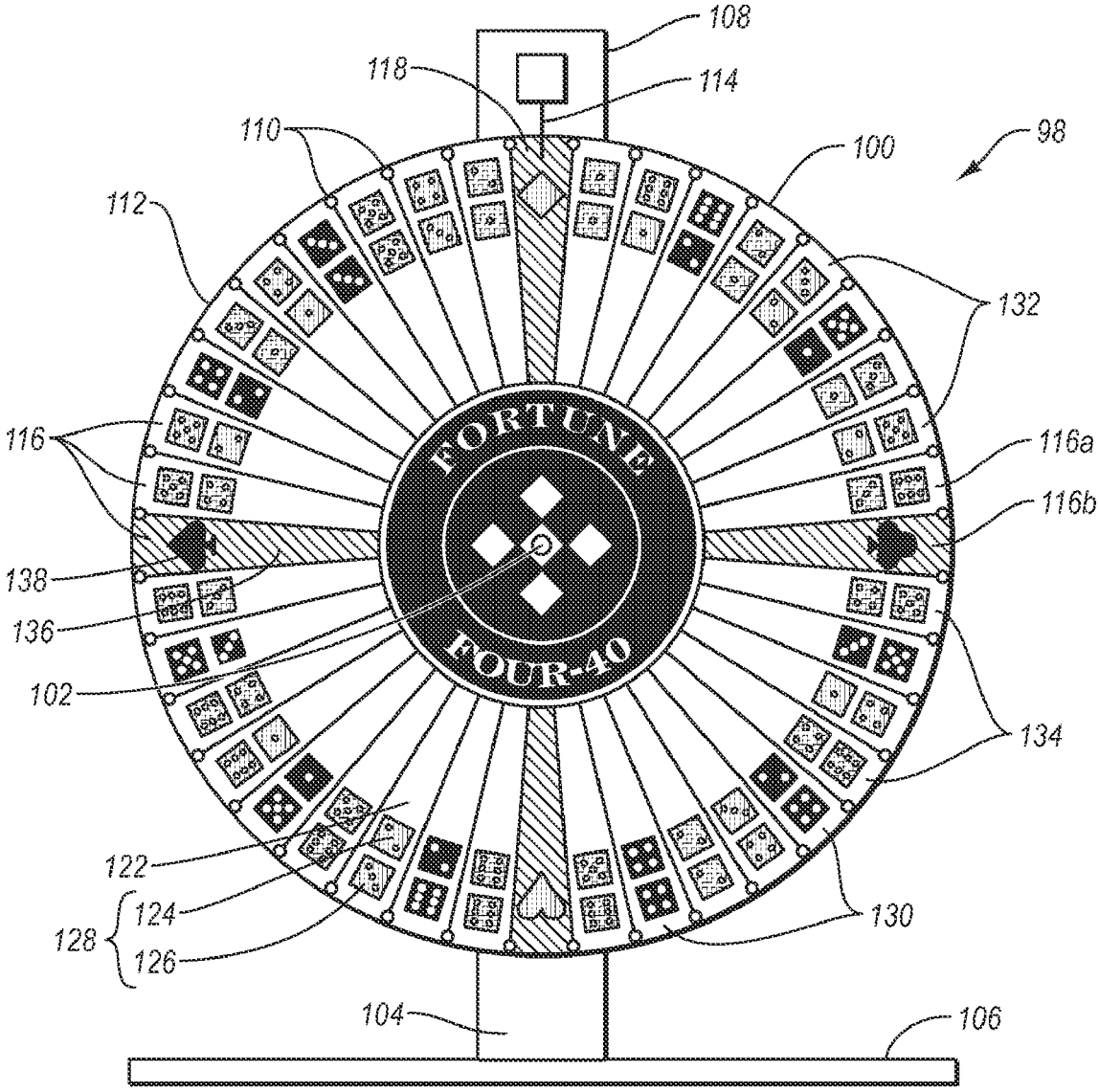
FIG. 1 is a front elevation view of a vertically oriented roulette wheel assembly for a game of chance according to one embodiment of the present invention.

Depicted in FIG. 1 is one embodiment of a roulette wheel assembly 98 according to the present invention. Roulette wheel assembly 98 includes a vertically mounted roulette wheel 100 which rotates in a substantially vertical plane about a horizontally disposed axle 102. The axle 102 extends from a substantially vertically disposed column 104, which extends upwardly from a base 106 to a top end 108. The face of the roulette wheel has a plurality of evenly spaced wheel sections 116. The roulette wheel assembly 98 also includes an indicator mechanism for randomly selecting one of the wheel sections 116. For example, in the depicted embodiment, the roulette wheel 100 includes a series of pins 110 disposed about the periphery 112 thereof and extending normal to the plane of the wheel 100, with a resilient pointer 114 extending from the top end 108 of column 104 to engage the pins 110 as the wheel 100 rotates. When the wheel stops rotating, the resilient pointer 114 is positioned between adjacent pins 110 so as to indicate one of the wheel sections 116, known as the randomly selected wheel section 118.

The plurality of wheel sections 116 is divided into different portions according to what is contained within the wheel sections. For example, in a first portion of wheel sections, each wheel section 116*a* includes a plurality of dice faces disposed thereon, each of the dice faces corresponding to a separate dice. As used herein, a "face of a die" or a "die face" or equivalent notation is defined as a face of an actual die that is mounted to the wheel 100, or a representation of a face of a die that is mounted or rendered on the wheel 100.

In a second portion of wheel sections, each wheel section 116*b* includes a depiction of a suit of a standard deck of playing cards disposed thereon. As used herein, a "depiction of a playing card suit" or a "card suit depiction" or equivalent notation can comprise an actual playing card that is mounted to the wheel 100 or a representation of the card or the suit that is mounted or rendered on the wheel 100.

In light of the above, the wheel sections 116*a* in the first portion of wheel sections (i.e., those wheel sections having multiple dice faces disposed thereon) are referred to herein as dice wheel sections 116*a*. Similarly, the wheel sections 116*b* in the second portion of wheel sections (i.e., those wheel sections having a depiction of a playing card suit disposed thereon) are referred to herein as card wheel sections 116*b*.

In the depicted embodiment, there are 36 dice wheel sections 116*a* and four card wheel sections 116*b* for a total of 40 wheel sections. Alternatively, there can be more or less total wheel sections 116 and/or a different number of each type of wheel section 116*a* and 116*b* on the wheel 100. Furthermore, although each of the wheel sections 116 in the depicted embodiment is either a dice wheel section 116*a* or a card wheel section 116*b*, this is not required. For example, other types of wheel sections 116 can be interspersed with the dice wheel sections 116*a* and the card wheel sections 116*b* on wheel 100.

Each of the dice wheel sections 116*a* has a background portion 122 and two faces 124 and 126 of dice mounted or painted thereon. All of the background portions 122 of the dice wheel sections 116*a* are similar to each other so that it is obvious that the dice wheel sections 116*a* are related. For example, the background portions 122 can be colored similarly, and/or can have a similar design or pattern disposed thereon.

The two faces 124 and 126 of dice mounted or painted on each dice wheel section 116*a* form a dice combination 128. Dice combinations are herein denoted "a-b", wherein a represents the number disposed on one of the die faces and b represents the number on the other die face. For example, if die faces 124 and 126 respectively represent a 1 and a 2, then the corresponding dice combination 128 is "1-2" or "2-1."

In the depicted embodiment, the dice faces 124 and 126 in each dice wheel section 116*a* are positioned radially so that the inner die face 124 is closer to the axle 102 of the wheel 100 than the outer die face 126. In other embodiments, the faces 124 and 126 can be positioned side by side so that both dice faces 124 and 126 are equidistant from the axle 102. Other arrangements are also possible.

There are 36 possible combinations available from a pair of six-sided dice. Each non-doubles dice combination (i.e., where the numbers represented on the selected faces of both dice do not match, e.g., "2-5" or "1-2") can be obtained in two manners because the face of either die can show either number. For example, the combination of a 1 and a 5 can be arrived at by the face of the first die representing a 1 and the face of the second die representing a 2 (i.e., "1-2") or the face of the first die representing a 2 and the face of the second die representing a 1 (i.e., "2-1"). In contrast, each doubles combination (e.g., "1-1" or "2-2") can only be obtained in one manner because the faces of both dice must represent the same number.

The numbers represented on the dice combinations 128 of the 36 dice wheel sections 116*a* correspond to all of the combinations available from a pair of standard six-sided dice. As such, according to the explanation above, each non-doubles dice combination is represented by two of the dice wheel sections 116*a* while each doubles dice combination is represented by only one of the dice wheel sections 116*a*.

For each dice wheel section 116*a*, the numbers represented by the faces 124 and 126 of the pair of dice are summed together to obtain a summation. For example a dice wheel section 116*a* in which the faces of the dice respectively represent a 3 and a 4 would have a summation of 7. The summations available from a pair of dice (and thus from the dice wheel sections 116*a*) range from 2 (the numbers represented on each pair of dice equaling 1) to 12 (the numbers represented on each pair of dice equaling 6).

According to one embodiment of the present invention, the faces 124 and 126 of the pair of dice in each dice wheel section 116*a* are painted a particular color based on the summation of the dice faces in the particular section. This can be done in a number of ways. For example, in one embodiment, each different summation is associated with a unique color. In that case, eleven different colors (for each of summations 2-12) are required to color the dice faces 124 and 126. In other embodiments, summations are grouped together, which reduce the number of separate colors used. For example, in the depicted embodiment, dice wheel sections 116*a* having summations of 6 or 8 are grouped together to define a first group 130, dice wheel sections 116*a* having summations of 5 or 7 are grouped together to define a second group 132; and dice wheel sections 116*a* having summations of 2, 3, 4, 9, 10, 11, or 12 are grouped together to define a third group 134. With a total of three dice groups (130, 132, and 134), only three colors are required to distinguish between the different groups. In the depicted embodiment, the colors of the first group 130, the second group 132, and the third group 134 are respectively black, red, and yellow. Of course, these colors can be rearranged or other colors can alternatively be used. Based on the above groups, there are ten dice wheel sections 116*a* in each of the first and second groups 130 and 132, and sixteen dice wheel sections 116*a* in the third group 134.

Similar to the dice wheel sections 116*a*, each of the card wheel sections 116*b* has a background portion 136. All of the background portions 136 of the card wheel sections 116*b* are similar to each other so that it is obvious that the card wheel sections 116*b* are related. The background portions 136 of the card wheel sections 116*b* are also different than the background portions 122 of the dice wheel sections 116*a* so as to differentiate between the two sections. For example, the background portions 136 can be colored similar to each other, but different than the background portions 122, and/or can have a design or pattern disposed thereon that is different from the background portions 122. If the differentiating factor is color, the background portions 136 of the card wheel sections 116*b* are colored in a different color than the colors that differentiate between the groups of dice wheel sections 116*a*. For example, in the depicted embodiment, the background portions 136 of the card wheel sections 116*b* are all colored green, which distinguishes over the black, red, and yellow colors used to differentiate the dice wheel section groups. Of course, other colors can alternatively be used.

There are four card wheel sections 116*b*, each corresponding to a different suit of a standard deck of playing cards. Accordingly, each card wheel section 116*b* contains a representation 138 of one of the suits of the standard deck. For example, in the depicted embodiment, the card wheel sections 116*b* respectively depict a heart, a diamond, a spade, and a club.

The card wheel sections 116*b* can be evenly distributed around the wheel 100, or can be positioned next to each other, or can be arranged in some combination of the two. For example, in the depicted embodiment the card wheel sections 116*b* are positioned so as to be evenly spaced from each other around the wheel 100.

Figure 2:
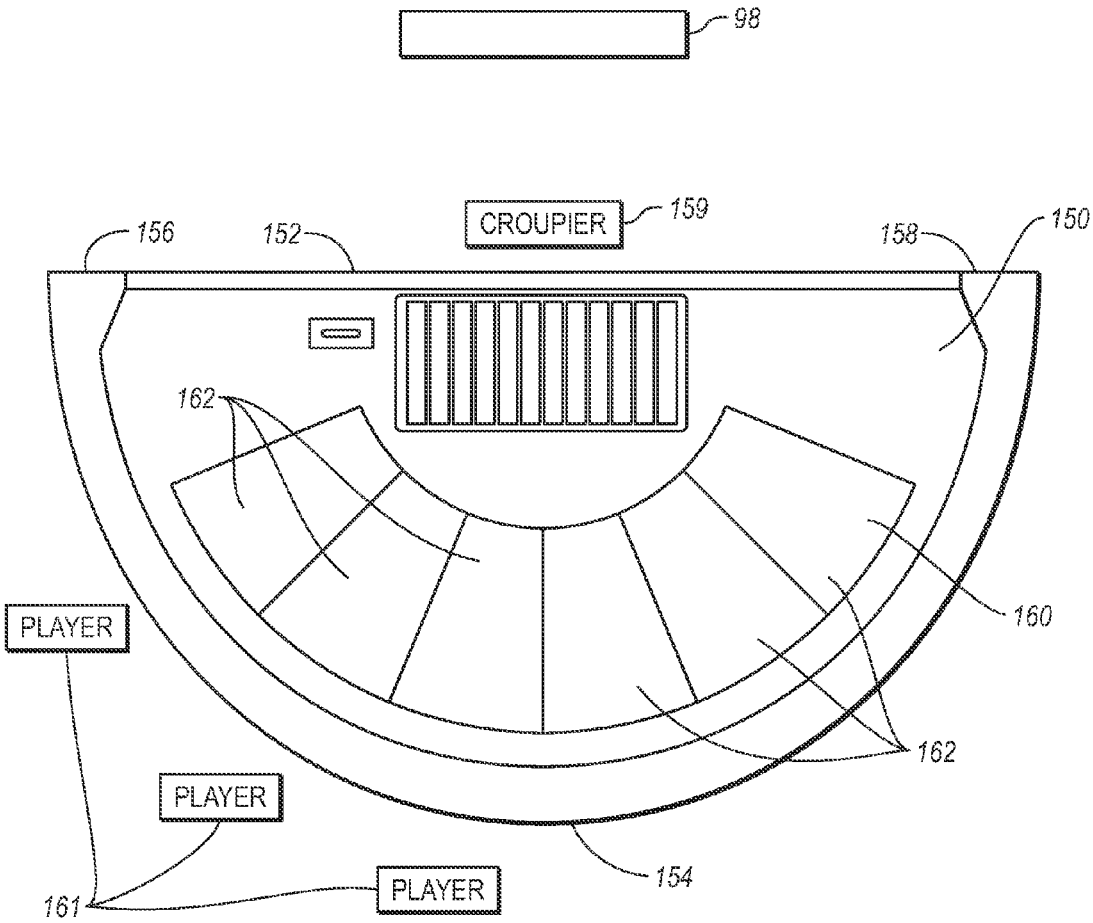
FIG. 2 is a top plan view of a playing surface for a game of chance according to one embodiment of the present invention.

Depicted in FIG. 2 is one embodiment of a playing surface 150 according to the present invention. The playing surface 150 can be a portion of a table or a tabletop or the like, as is known in the art.

As shown in FIG. 2, playing surface 150 is generally semicircular, having a substantially linear inner edge 152 and a curved outer edge 154 extending between a first end 156 and a second end 158. The playing surface 150 is configured so that a croupier 159 and game players 161 can be positioned respectively at the inner edge 152 and the outer edge 154, similar to other casino games, such as blackjack or the like. Although three players 161 are depicted in FIG. 2, it is appreciated that more or less number of players are also possible.

Figure 3:
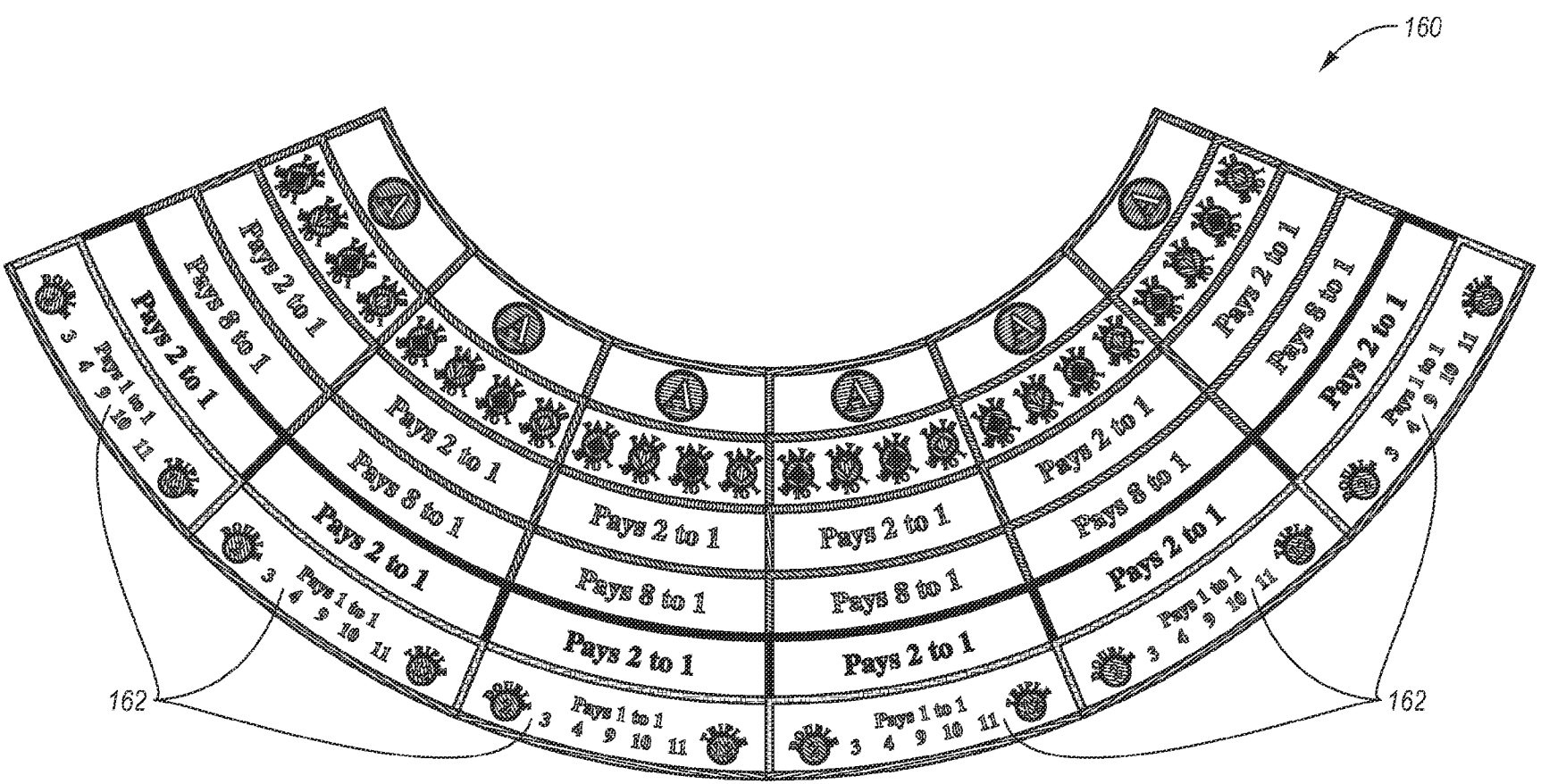
FIG. 3 is a top plan view of the wagering area shown in FIG. 2, showing more detail.

Playing surface 150 contains a wagering area 160 that can cover the entire playing surface 150 or, as in the depicted embodiment, only a portion thereof As shown in FIG. 3 in conjunction with FIG. 2, Wagering area 160 has a plurality of playing positions 162 that are substantially identical to each other. Wagering area 160 is designed so that game players 161 can position themselves around the outer edge 154 of playing surface 150 at a different playing position 162 and place wagers thereon corresponding to each spin of the wheel 100. The number of playing positions 162 can vary. In the depicted embodiment there are six playing positions 162, but more or less than this is also possible.

Figure 4:
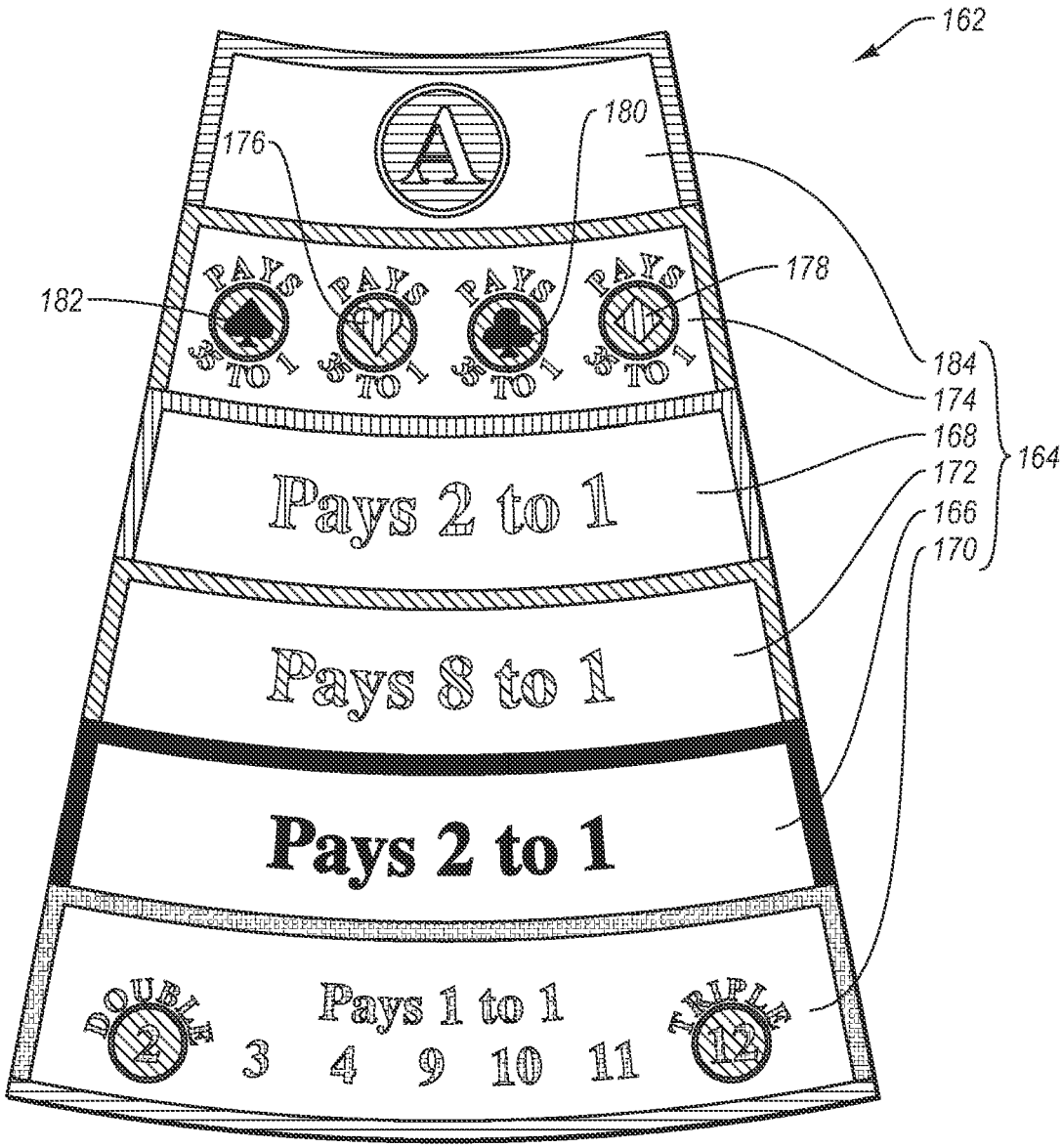
FIG. 4 is a top plan view of a portion of the playing surface depicted in FIG. 3, showing one of the playing positions of the wagering area.

Turning to FIG. 4, each playing position 162 comprises a plurality of wager sections 164 corresponding to the wheel sections 116 on the roulette wheel 100 and groups discussed above. For example, in the depicted embodiment, three wager sections (166, 168, 170) correspond to the dice wheel sections 116*a* and two wager sections (172, 174) correspond to the card wheel sections 116*b*.

The first wager section 166 corresponds to the first group 130 of dice wheel sections 116*a* on the wheel 100, i.e., those dice wheel sections 116*a* having summations of 6 or 8. Because ten of the forty wheel sections 116 on wheel 100 correspond to first group 130, the odds of the pointer 114 randomly selecting one of the dice wheel sections 116*a* corresponding to the first group 130 is 4 to 1. Those odds or the house's established payout amount can be printed in the first wager section. For example, in the depicted embodiment, the payout is printed: "Pays 2 to 1." As noted above, the dice faces 124 and 126 associated with the first group 130 are colored black on the wheel 100. Therefore, to help the game player coordinate the first wager section 166 with the first group 130 on the wheel 100, the letters within the first wager section 166 are also colored black.

The second wager section 168 corresponds to the second group 132 of dice wheel sections 116*a* on the wheel 100, i.e., those dice wheel sections 116*a* having summations of 5 or 7. Similar to that of first group 130, because ten of the forty wheel sections 116 on wheel 100 correspond to second group 132, the odds of the pointer 114 randomly selecting one of the dice wheel sections 116*a* corresponding to the second group 132 is also 4 to 1. Also similar to first wager section 166, the payout is printed within second wager section 168: "Pays 2 to 1." As noted above, the dice faces 124 and 126 associated with the second group 132 are colored red on the wheel 100. Therefore, to help the game player coordinate the second wager section 168 with the second group 132 on the wheel 100, the letters within the second wager section 168 are also colored red.

The third wager section 170 corresponds to the third group 134 of dice wheel sections 116*a* on the wheel 100, i.e., those dice wheel sections 116*a* having summations of 2, 3, 4, 9, 10, 11, or 12. Because 16 of the forty wheel sections 116 on wheel 100 correspond to third group 134, the odds of the pointer 114 randomly selecting one of the dice wheel sections 116*a* corresponding to the third group 134 is 5 to 2. Similar to first and second wager sections 166 and 168, the payout is printed within third wager section 170: "Pays 1 to 1." The third wager section 170 is different than the first and second wager sections 166 and 170 in that the third wager section 170 also displays the individual summations within the third group 134 and gives different payouts depending on which summation of the third group 134 corresponds to the randomly selected wheel section 116 on the wheel 100. As shown in FIG. 4, a summation of 2 or 12 gives a different payout than the other summations. As shown in the third wager section 170, the dice wheel section 116 corresponding to a summation of 2 will yield a "double" payout (i.e., 2 to 1), and the dice wheel section 116*a* corresponding to a summation of 12 will yield a "triple" payout (i.e., 3 to 1). As noted above, the dice faces 124 and 126 associated with the third group 134 are colored yellow on the wheel 100. Therefore, to help the game player coordinate the third wager section 170 with the third group 134 on the wheel 100, the letters within the third wager section 170 are also colored yellow.

The fourth wager section 172 corresponds to the card wheel sections 116*b* on the wheel 100. Because 4 of the forty wheel sections 116 on wheel 100 correspond to the card wheel sections 116*b*, the odds of the pointer 114 randomly selecting one of the card wheel sections 116*b* is 10 to 1. Similar to the first three wager sections 166, 168, and 170, the payout is printed within fourth wager section 172: "Pays 8 to 1." As noted above, the background portions 136 of the card wheel sections 116*b* are all colored green on the wheel 100. Therefore, to help the game player coordinate the fourth wager section 172 with the card wheel sections 116*b* on the wheel 100, the letters within the fourth wager section 172 are also colored green.

The fifth wager section 174 also corresponds to the card wheel sections 116*b* on the wheel 100. However, unlike the fourth wager section 174 that corresponds to all of the card wheel sections 116*b*, the fifth wager section 174 contains a separate portion corresponding to each of the suits represented by the card wheel sections 116*b*. That is, the fifth wager section 174 allows wagering on the individual playing card suits. To that end, displayed in fifth wager section 174 are representations of the card suits, one each for hearts 176, diamonds 178, clubs 180, and spades 182. Each of the representations 176, 178, 180, and 182 includes a payout amount for the individual card suit.

Besides lettering colors, it is appreciated that the coordination of the wager sections 164 with corresponding groups on the wheel 100 can be done in other ways. For example, the background of the particular wager section 164 could be colored to match the color of the corresponding grouping on the wheel 100. Other ways of coordination can also be used.

It is also appreciated that other indicia may be used within each wager sections 164 other than the payout amount. For example, the summation number(s) can alternatively be used. Alternatively, pictures such as icons can be used to associate each wager section 164 with the corresponding wheel section 116 or group. Furthermore, the payout amounts discussed above are exemplary only. The gambling establishment can of course determine different payout amounts if so desired.

A sixth wager section 184 may also be included to provide a location for a game player to place his ante onto the table or to allow wagering on other things, such as whether another player will win. For example, in the depicted embodiment the sixth wager section 184 is used for an ante and thus has a large "A" imprinted thereon for that purpose.

Although the wager sections 164 are depicted in a particular order in FIG. 4, this is not necessary. It is appreciated that the wager sections 164 can be organized in any manner.

During play, the roulette wheel assembly 98 is set up to face the playing surface 150 with the inner edge 152 of the playing surface 150 being the closest portion of the playing surface 150 to the wheel assembly 98, as shown in FIG. 2. The croupier 159 is positioned between the wheel assembly 98 and the playing surface 150. The one or more players 161 are positioned, usually seated, around the outer edge 154 of the playing surface 150 so as to generally face the wheel 100. Each player is positioned at a separate playing position 162. Each player places a wager on one or more of the wager sections 164 corresponding to his playing position 162. As discussed above, wager sections 166, 168, 170, 172, 174, correspond to different wheel sections 116 or groups on the wheel 100. For example, if the player places a wager in the first wager section 166, the player is wagering that one of the wheel sections 116 corresponding to the first group will be randomly selected.

If a player places a wager on the fifth wager section, the player must place the wager on one of the suit representations 176, 178, 180, or 182. By so doing, the player is wagering that the card wheel section 116 corresponding to the particular card suit representation will be randomly selected. The player is not necessarily limited to a single wager. That is, the player can place wagers on more than one wager section 164 during a single spin of the wheel if the gambling establishment desires.

Once all of the wagers have been placed on the playing surface 150, the wheel 100 is spun by the croupier. As the wheel 100 spins, the resilient pointer 114 contacts the pins 110 as the pins 110 pass the pointer 114, thereby gradually slowing the wheel 100 down, as is known in the art. The wheel 100 eventually stops with the resilient pointer 114 being positioned between two adjacent pins 110 so as to "point" to the randomly selected wheel section 118.

Each player that has placed a wager on a wager section corresponding to the selected wheel section 118 wins an amount based on the amount of the wager times the payout amount. For example, if the player had placed a $10 wager on second wager section 168 and the selected wheel section 118 contains two dice faces 124 and 126 that sum up to 7 (i.e., the selected wheel section 118 corresponds to the second group 132), the player receives his $10 back plus a payout of $20 ($10 times the payout of 2 to 1). If the selected wheel section 118 is a card wheel section 116, each player that has placed a wager on the fourth wager section 172 is declared a winner and receives winnings corresponding to the established payout (8 to 1 in the exemplary embodiment) and each player that has placed a wager on the particular suit representation 176, 178, 180, or 182 in the fifth wager section 174 corresponding to the suit 138 depicted on the randomly selected wheel section 116 is also declared a winner and receives winnings corresponding to the established payout (35 to 1 in the exemplary embodiment).

Note that if the selected wheel section 118 corresponds to the third group 134, the payout for the players who placed wagers in the third wager section 170 depends on the sum of the dice faces 124 and 126 associated with the selected wheel section 118. If the sum of the dice faces 124 and 126 is two or twelve, the payout is respectively 2 to 1 and 3 to 1; otherwise the payout is 1 to 1. As noted above, the listed payouts are exemplary only and can be established by the gambling establishment.

As is known in the art, all wagers placed on wager sections 164 that do not correspond to the selected wheel section 116 are forfeited to the gambling establishment and removed from the playing surface by the croupier. If the sixth wager section is used as an ante section, each player will place a predetermined ante amount before each spin of the wheel.

As is known in the art, cash, chips, or the like may be used as a form of wagering.

Figure 5:
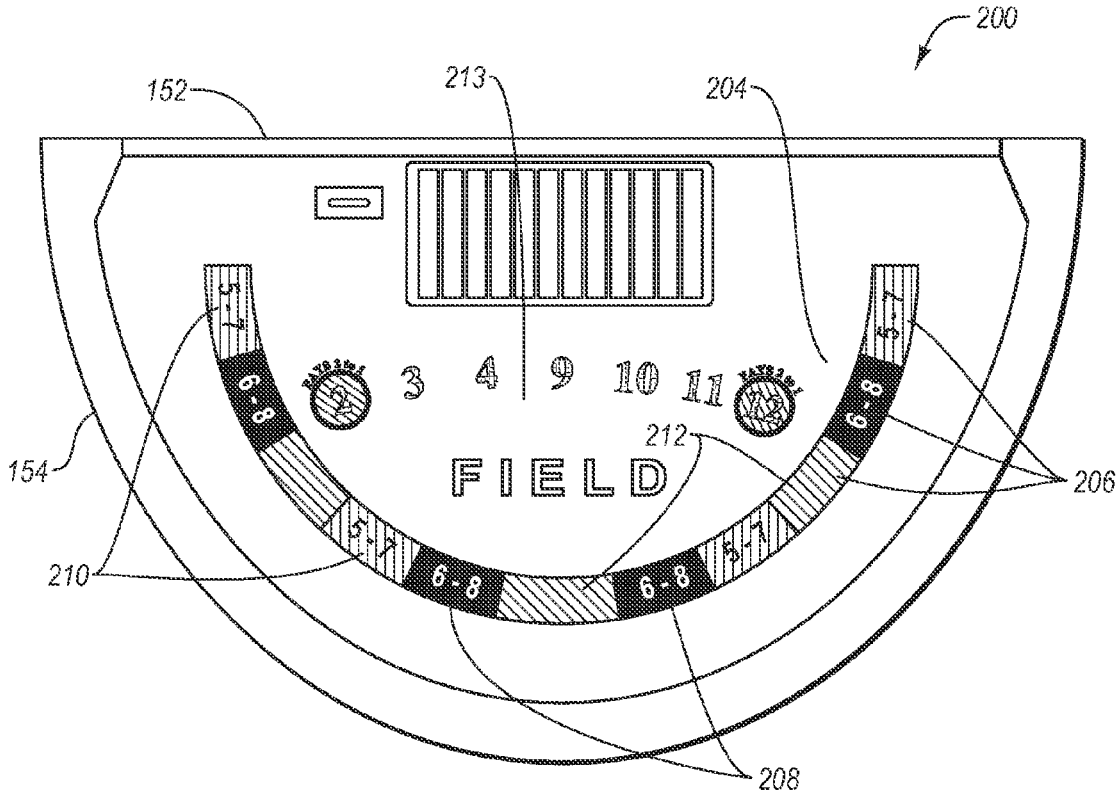
FIG. 5 is a top plan view of a playing surface for a roulette game according to another embodiment of the present invention.

Depicted in FIG. 5 is another embodiment of a playing surface 200 according to the present invention. Like elements between playing surface 200 and playing surface 150 are identified by like reference characters. Similar to playing surface 150, playing surface 200 can be a portion of a table or a tabletop or the like, as is known in the art.

Similar to playing surface 150, playing surface 200 has a generally linear inner edge 152 and semicircular outer edge 154. However, instead of the wagering area 160 having a separate playing position 162 for each player, wagering area 204 includes wager sections 206 that are shared between players. For example, four separate first wager sections 208 are distributed about the playing surface 200. Similar to the first wager sections 166 on playing surface 150, the first wager sections 208 correspond to the first group 130 of dice wheel sections 116*a* on the wheel 100. Similarly, four separate second wager sections 210 corresponding to the second group 132 and three separate fourth wager sections 212 corresponding to the card wheel sections 116*b* are also distributed about the playing surface 200.

In the depicted embodiment, the first, second, and fourth wager sections 208, 210, 212 together form a portion of an arc, though this is not required. Furthermore, instead of displaying the payout amounts, the first and second wager sections 208 and 210 display the summations associated with the groups corresponding to the particular wager section and the fourth wager section 212 contains no lettering or numbering. Each of the wager sections 208, 210, and 212 on playing surface 200 also displays a background color that matches the color of the background portion 122 or 136 associated with the corresponding wheel sections 116.

Instead of having a plurality of third wager sections 170, wagering area 204 uses the field portion of the playing surface as a third wager section 214. That is, a wager placed on the wagering area 204 but outside of the delineated wager sections 208, 210, and 212 constitutes a wager in the third wager section 214. Similar to the third wager section 170, different payout amounts are displayed for a summation of 2 or 12 in the third wager section 214.

Note that playing surface 200 does not include a separate fifth wager section 174 displaying each of the particular card suit representations. Instead, a lammer or marker (not shown), having a representation of one of the suits is used to place a wager on a particular playing card suit, as discussed below.

Using playing surface 200, the method of play is generally the same as with playing surface 150. Wagers are placed, the wheel 100 is spun, and winnings are paid out based on the randomly selected wheel section 118. As noted above, because the field portion of the table is used as a third wager section 214, any wager placed outside of the delineated wager sections 208, 210, 212 constitutes a wager in the third wager section 214.

Furthermore, as noted above, to place a wager on a particular playing card suit, a lammer or marker having a representation of the particular suit is used. The lammer is placed on top of the desired wager amount within the fourth wager sections 212 so that the desired card suit is showing on the lammer. This establishes that the wager is directed toward the particular suit shown on the lammer. If the suit displayed on the lammer corresponds to the selected wheel section 118, the player who placed the wager wins and receives winnings corresponding to the established payout, as described previously.

It is appreciated that other alternative embodiments of the present invention are also possible. For example, other types of indicator mechanisms for randomly selecting one of the wheel sections can alternatively be used. In one embodiment, instead of a vertically oriented roulette wheel 100, a horizontally oriented roulette wheel is used. In this embodiment, the indicator mechanism for randomly selecting one of the wheel sections comprises a ball and a plurality of pockets associated with the wheel sections. During a spin of the wheel, the ball randomly drops into one of the pockets corresponding to a wheel section, as is known in the art. Other indicator mechanisms for randomly selecting one of the wheel sections can also be used.

Also, variations in the number and type of wheel sections 116 are also possible. For example, in one embodiment, no card wheel sections 116*b* are included on the wheel 100. That is, only dice wheel sections 116*a* are used. In this embodiment, the wager sections corresponding to the card wheel sections 116*b* are removed from the playing surface or simply not used and the odds and payout are adjusted accordingly. The corresponding card wheel sections 116*b* can also be removed from the wheel 100 so the wheel only has a total of thirty six wheel sections 116. In another embodiment, the card wheel sections 116*b* are used, but no wagering is allowed on a particular suit. In this embodiment, the wager section corresponding to the particular suit representations are removed from the playing surface or simply not used and the odds and payout are adjusted accordingly. Other variations are also possible.

Furthermore, variations in the types and number of groups of the wheel sections 116 are also possible. For example, although only three groups of the dice wheel sections 116*a* are described herein, in other embodiments more or less groups are alternatively used. Furthermore, groups based on even vs. odd, above and below a certain summation, etc. can alternatively be used.

In addition, variations in the type of representations shown on the wheel sections can alternatively be used. For example, in one embodiment other types of number representations are used in place of dice representations. That is, instead of a pair of dice faces, each dice wheel section includes a pair of other number representations. The pair of number representations are summed to produce a summation, similar to the embodiments described herein. Additionally, other types of representations can be used in place of card suit representations.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A game apparatus comprising:

a rotatable roulette wheel having only a total of exactly forty wheel sections, the forty wheel sections being divided into:

a first portion having only a total of exactly thirty six wheel sections, each wheel section in the first portion having two separate number representations that when summed represent a summation for the particular wheel section, each of the wheel sections in the first portion corresponding to one of the thirty six different combinations possible from a standard pair of six-sided dice; and a second portion having only a total of exactly four wheel sections, each wheel section in the second portion having indicia corresponding to a playing card suit disposed thereon, each of the wheel sections in the second portion representing a different playing card suit;

an indicator mechanism associated with the rotatable roulette wheel for randomly selecting one of the forty wheel sections; and a playing surface comprising a wagering area adapted for placing wagers concerning the randomly selected wheel section.

2. The game apparatus as recited in claim 1, wherein each wheel section of the first portion has disposed thereon a representation of the faces of the pair of dice.

3. The game apparatus as recited in claim 2, wherein the first portion includes one wheel section corresponding to each doubles combination possible from a standard pair of six-sided dice and two wheel sections corresponding to each non-doubles combination possible from a standard pair of six-sided dice.

4. The game apparatus as recited in claim 1, wherein the wheel sections of the first portion with a same summation are associated with a same color.

5. The game apparatus as recited in claim 4, wherein:

each wheel section having a summation of 5 or 7 is associated with a first color;

each wheel section having a summation of 6 or 8 is associated with a second color; and each wheel section having a summation of 2, 3, 4, 9, 10, 11, and 12 is associated with a third color.

6. The game apparatus as recited in claim 5, wherein the wheel sections in the second portion are associated with a fourth color.

7. The game apparatus as recited in claim 6, wherein the number of wheel sections corresponding to the first color is 10, the number of wheel sections corresponding to the second color is 10, the number of wheel sections corresponding to the third color is 16, and the number of wheel sections corresponding to the fourth color is 4.

8. The game apparatus as recited in claim 1, wherein the four wheel sections of the second portion respectively correspond to hearts, diamonds, clubs and spades.

9. The game apparatus as recited in claim 1, wherein the indicator mechanism comprises a plurality of pins disposed on the rotatable roulette wheel and a resilient pointer.

10. The game apparatus as recited in claim 1, wherein the wagering area comprises a plurality of wager sections corresponding to the summations of the wheel sections on the roulette wheel.

11. The game apparatus as recited in claim 10, wherein the plurality of wager sections comprises:

a first wager section corresponding to wheel sections having summations of 5 and 7;

a second wager section corresponding to wheel sections having summations of 6 and 8; and a third wager section corresponding to wheel sections having summations of 2, 3, 4, 9, 10, 11, and 12.

12. The game apparatus as recited in claim 10, wherein the wagering area further comprises one or more additional wager sections corresponding to the second portion of wheel sections.

13. The game apparatus as recited in claim 1, wherein the roulette wheel is substantially vertically oriented.

14. A game apparatus comprising:

a rotatable roulette wheel having only a total of exactly forty wheel sections, the forty wheel sections being divided into a first portion having only a total of exactly thirty six wheel sections and a second portion having only a total of exactly four wheel sections, each wheel section in the first portion having two separate dice faces disposed thereon, the dice faces having number representations thereon that when summed represent a summation for the wheel section; and each wheel section in the second portion having a representation of a suit of a playing card disposed thereon, each of the wheel sections in the second portion representing a different playing card suit;

an indicator mechanism associated with the rotatable roulette wheel for randomly selecting one of the forty wheel sections; and a playing surface comprising a wagering area adapted for placing wagers concerning the randomly selected wheel section, the wagering area comprising a plurality of wager sections corresponding to the summations of the wheel sections and the card suit representations.

15. A method of playing a game of chance, the method comprising:

providing a playing surface;

providing a rotatable roulette wheel;

placing at least one wager on at least one wager section of the playing surface, the at least one wager section being a subset of a plurality of wager sections of the playing surface corresponding to the outcome of a spin of the roulette wheel, the roulette wheel comprising only a total of exactly forty wheel sections, the forty wheel sections being divided into a first portion having only a total of exactly thirty six of the wheel sections and a second portion having only a total of exactly four of the wheel sections, wherein each wheel section of the first portion has a first face of a die and a second face of a die disposed thereon, the value of the first and second faces of the dice in each wheel section of the first portion summing up to a summation, and each wheel of the second portion has a representation of a suit of a deck of playing cards disposed thereon, each of the wheel sections in the second portion representing a different playing card suit;

randomly selecting a wheel section by spinning the roulette wheel and allowing an indicator mechanism to indicate one of the wheel sections within the plurality of wheel sections;

determining the outcome of the wager by matching the summation of the randomly selected wheel section with a winning wager section if the selected wheel section corresponds to one of the first portion of wheel sections, wherein a multiple of the wager is received if the winning wager section matches the at least one wager section where the at least one wager was placed.

16. The method as recited in claim 15, wherein:

determining the outcome of the wager further comprises matching the second plurality of wheel sections with a winning wager section if the randomly selected wheel section corresponds to one of the second portion of wheel sections.

17. The method as recited in claim 16, wherein:

determining the outcome of the wager further comprises matching the playing card suit represented on the randomly selected wheel section with the winning wager section if the selected wheel section corresponds to one of the second portion of wheel sections.

* * * * *